United States Patent [19]

Köbler et al.

[11] 4,401,028

[45] Aug. 30, 1983

[54] PRINTING MACHINE WEB GUIDING ARRANGEMENT

[75] Inventors: Ingo Köbler, Anhausen; Rainer Burger, Augsburg, both of Fed. Rep. of Germany

[73] Assignee: M.A.N.-Roland Druckmaschinen Aktiengesellschaft, Offenbach am Main, Fed. Rep. of Germany

[21] Appl. No.: 314,494

[22] Filed: Oct. 23, 1981

[30] Foreign Application Priority Data

Nov. 29, 1980 [DE] Fed. Rep. of Germany ..... 3045051

[51] Int. Cl.[3] ..... B41F 5/08; B41F 13/02

[52] U.S. Cl. ..... 101/178; 101/228

[58] Field of Search ..... 101/219, 228, 138, 139, 101/143, 176, 177, 178, 179, 180, 181, 220, 225; 226/91, 189

[56] References Cited

U.S. PATENT DOCUMENTS 4,325,301 4/1982 Grosshauser ..... 101/228 X

FOREIGN PATENT DOCUMENTS 2409219 9/1975 Fed. Rep. of Germany ..... 101/179
2422696 11/1975 Fed. Rep. of Germany ..... 101/178
2741596 3/1978 Fed. Rep. of Germany ..... 101/228

*Primary Examiner*—J. Reed Fisher

[57] ABSTRACT

To permit ready access of operators to printing cylinders located above each other, in which the paper web is introduced laterally towards the cylinders in an upwardly directed path, a guide roller (6) is provided which is held at the end of pivot arms (8) and movable from a position remote from the printing cylinders, so that the upwardly directed path (A) will provide access to an operator standing beneath the then horizontally extending portion of the path, and a position close to the printing cylinders, so that the upwardly extending path (A') will be close to the printing cylinders and permit an operator standing on a movable platform (10) to reach the upper printing cylinders (right side of the figure). The movable platform (10) preferably is hinged upwardly of a platform on which the operator can stand if access to the lower cylinders is desired.

4 Claims, 1 Drawing Figure

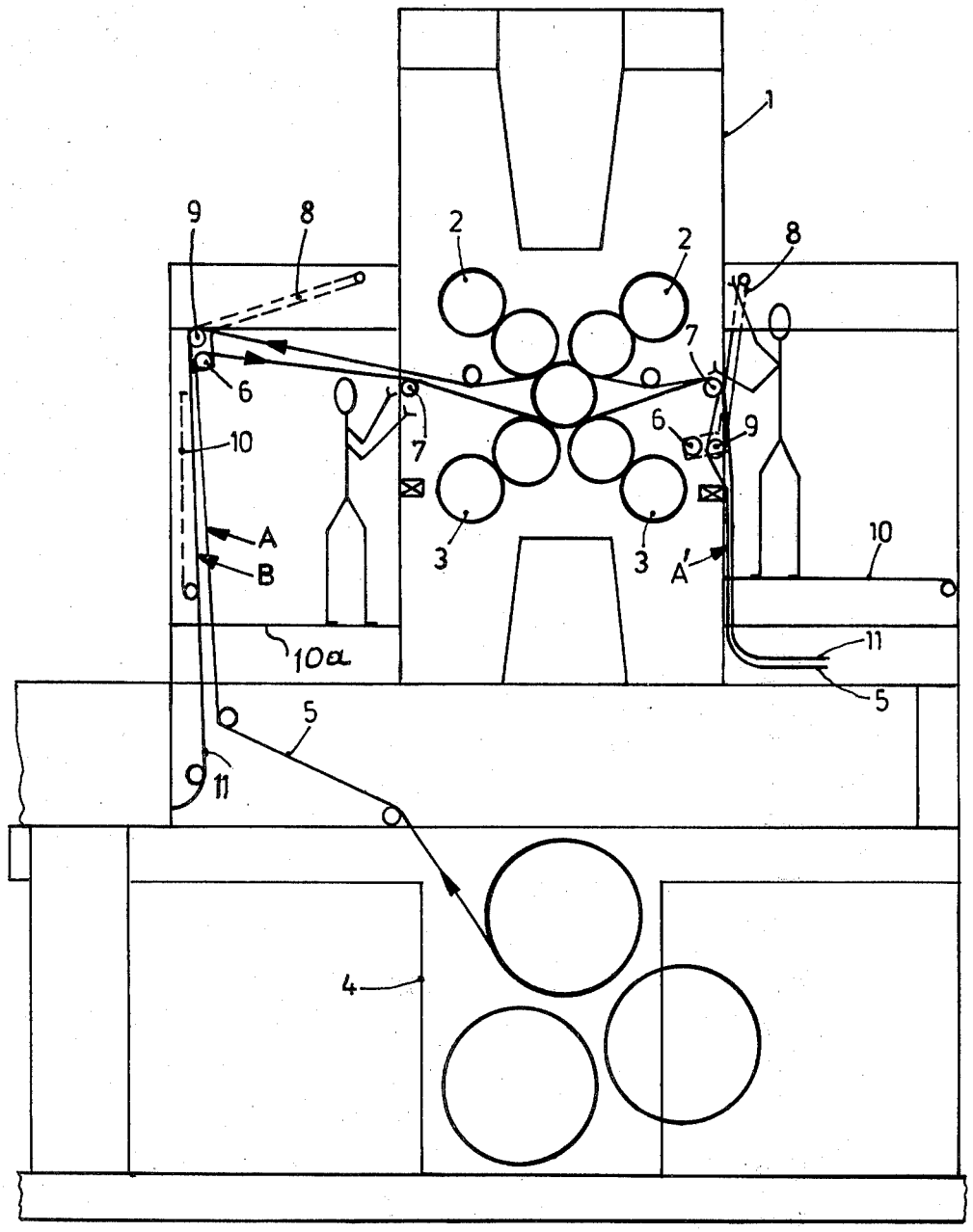
1
2
2
3
3
4
5
5
6
6
7
7
8
8
9
9
10
10
10a
11
11
A
B
A'

PRINTING MACHINE WEB GUIDING ARRANGEMENT

Reference to related application, assigned to the assignee of the present invention:

U.S. Ser. No. 301,319, filed Sept. 11, 1981, BURGER.

The present invention relates to printing machines, and more particularly to a rotary printing machine, for example an offset printing machine, in which a web of paper is guided in a vertically or upwardly directed path, and means are provided to change the position of the path of the paper web before the web enters into a printing station of the printing machine.

BACKGROUND

The referenced copending application, assigned to the assignee of this application, U.S. Ser. No. 301,319, filed Sept. 11, 1981, BURGER, discloses a printing machine in which a support carrier for an operator is arranged to carry a guide roller, so that the path of a paper web can be changed, selectively, to permit ready access to the printing system, in dependence upon whether the operator stands on the support or not. The textbook "Techniken, Systeme, Maschinen" ("Technology, Systems, Machinery"), page 9, FIG. 17*b*, 2nd Fig. from left, Oscar FREI, published by Polygraph-Verlag, discloses a printing system in which a paper web is guided vertically, and the path is determined by guide rollers. The path is fixed. Application of a paper web to a printing machine from below permits relatively good accessibility to the lower printing cylinders; particularly when applied to newspaper printing machinery, however, such a paper path results in difficulties regarding accessibility with respect to the upper printing cylinders. It is difficult to reach the upper printing cylinders, for example to change their plates, since access to the cylinders is impaired by the paper web itself. Of course, it would be possible to place the path of the paper web which extends upwardly closer to the printing machine cylinders, so that the path of the web, entering the cylinders laterally, permit better access to the upper printing cylinders. If this solution is adopted, however, the paper web then will cover the lower printing cylinders, so that the access to the lower ones is impaired.

THE INVENTION

It is an object to provide a printing system of the type above referred to in which access to both the upper as well as the lower sets of printing cylinders can be easily obtained, without losing the advantages of an upwardly directed paper feed path.

Briefly, paper is supplied in an upwardly directed path for subsequent introduction, laterally, between two printing cylinders of a printing station; one of the guide rollers guiding the paper is movable in a direction towards and away from the printing station, thereby changing the relative position of the upwardly directed path with respect to the printing cylinders. When close to the printing cylinders, access to the upper cylinders is easily available; when located away from the printing cylinders, the lower printing cylinders will have ready access. To permit working on the upper cylinders, a movable support platform is provided and located at the side of the web remote from the printing cylinders so that, when the guide rollers is shifted close to the printing cylinders, the platform the platform can be lowered, thus permitting an operator ready access to the higher-position, upper ones of the cylinders of the printing machine.

The arrangement has the advantage that it is only necessary to shift a single guide roller which, for example, can be secured to a pivotable carrier, in a direction between close to and away from the printing cylinder array. The paper path thus is changed so that, either, it will rise close to or adjacent the printing cylinders and, when so placed, permits the support carrier to be positioned so that an operator can readily have access to the upper cylinders for working on the cylinders, or the inking or damping system, respectively. Upon removal of the support platform from the working position, for example by pivoting it upwardly, the guide roller can likewise be re-positioned to move the upwardly directed path of the paper web away from proximity with the printing cylinders, thus permitting an operator ready access to the printing cylinders and rollers below the paper web, or their damping and inking fountain systems, respectively.

The direction of travel of the paper web in the path, of course, is immaterial; it is the direction of the path itself which matters—and the paper web may either travel upwardly or downwardly, in the respective path. Also, it is immaterial as to whether the paper enters the printing machine or leaves the printing machine for purposes of the present invention since, of course, an operator may wish to have access to either the entry or exit side, or both, of the printing system.

DRAWING

The single FIGURE is a highly schematic side view of a printing machine, illustrating only those features necessary for an understanding of the present invention.

A 9-cylinder rotary offset printing machine is illustrated, for example for newspaper printing use. Only the upper and lower plate cylinders 2, 3 of the printing systems located on either side of the printing station are specifically identified; they cooperate, as is customary, each with a blanket cylinder which, again, is engageable with a central impression cylinder.

The general frame structure of the machine 1 is H-shaped. Beneath the frame structure, a paper roll support spider is positioned, shown schematically at 4. One of the rolls of the paper roll spider 4 supplies paper laterally to the printing system. A web 5 is guided by various guide rollers—not further specifically identified—until the web is deflected by web guide roller 6 which guides the web into the printing station 1.

An operator, shown schematically, may readily work on the lower printing cylinders, as schematically shown at the left side. For example, when the machine is stopped, the plate on plate cylinder 3 can easily be changed. Accessibility to the upper printing cylinders, however, is impaired by the paper web 5 which laterally enters the printing station 1.

In accordance with the present invention, the paper guide roller 6 is movable to permit, in simple manner, access to the upper printing cylinders as well, so that necessary maintenance, repair or change or set-up operations can be carried out. The paper guide roller 6 is moved in direction of the printing cylinder system 2, 3. Two pivotable carrier arms 8 are provided. The paper guide roller 6 is secured to the freely pivotable ends of the arms 8.

The arms 8, shown on the left side of the printing system 1, can be pivoted about a pivot point close to the printing cylinders from an approximately horizontal direction in counter-clockwise direction toward the printing cylinders which will move the paper guide roller 6 towards and close to the printing cylinder system 2, 3. The position of the arms 8 and of the guide roller 6, then, will be essentially vertically as shown at the right of the figure. The vertically directed portion A of the printing machine path, leading to the printing cylinder system 2, 3, is re-positioned close to the printing cylinders, and, as illustrated at the right side of the figure, the vertically directed path will now have the portion A' extending approximately vertically and close to the printing cylinder system 2, 3. To provide ready access to the upper cylinders, and the appropriate level, a platform 10 and pivotably secured to the frame of the machine, is pivoted downwardly to permit an operator to readily reach the upper printing cylinder system to operate, for example, on the plate cylinder 2. The pivot axis of the platform 10 is outside of web 5. No interference from the platform will thus occur between the platform and the upwardly directed path A.

The present invention may, of course, also be used with multiple paper webs. For example, a second paper web 11 can be guided through a printing station. If this is desired, a second guide roller 9 is located close to the guide roller 6, for example thereabove, so that the paper web 11 can pass through the printing station in essentially the same guide path. The direction of movement of the paper webs is shown by the arrows, and, as illustrated, in opposite direction.

Similarly to the change of the guide path A, the upwardly directed guide path B can be changed as shown at the right side of the figure, where the guide roller 9 is moved similarly to the guide roller 6, by being carried on a carrier bracket attached to the pivot arm 8. The upwardly directed path of the web thus has changed from a position remote from the printing station 1 to one close thereto.

Intermediate positions of the guide arm 8, or of the rollers 6, 9, respectively, will result in release of tension of the paper web. Thus, either by shifting of the support bracket on which the rollers 8, 9 are located, or by partial pivoting of the arm 8, tension on the webs can be released, if such is required.

Additional guide rollers to guide the paper web at positions beneath the operator stations are shown only schematically, or have been omitted since such guide rollers are well known and standard in the field; likewise, the upwardly directed path need not extend vertically, but may extend at a slant, provided the angle of inclination is not such as to interfere with accessibility. The position of the pivot point for the platform 10 has been selected arbitrarily and, for example, can be higher or lower, as required for actual machine structure. Preferably, the pivot point for platform 10 is above a lower platform 10*a* for access to the lower printing cylinders 3.

An inlet guide roller 7 can be provided as shown; only one such guide roller for the web 5 is illustrated, a similar guide roller being provided, for example, for the web 11 if such is desired, and omitted from the drawing for clarity.

Various changes and modifications may be made within the scope of the inventive concept.

We claim:

1. Printing machine having a frame structure (1);

a printing station having two printing cylinders (2, 3);

means (4) supplying at least one web (5, 11) of paper on which printing is to be effected;

and guide roller means guiding said at least one web of paper in an upwardly directed path from a supply means (4) to the printing station and laterally between said two printing cylinders, comprising a selectively positionable guide roller (6), movable in a direction toward and away from the printing cylinders;

a pivot arm (8) having a pivot point at one end adjacent the printing station, carrying said guide roller (6) at the other end, and selectively positionable, in, respectively, approximately horizontal direction or approximate vertical direction to place the guide roller (6) remote from the printing station, when the pivot arm is positioned in horizontal direction, thereby placing the upwardly directed path of the web remote from the printing station, or, selectively, to place the guide roller (6) close to the printing station and at the distance from the pivot point corresponding to the length of the pivot arm, and thereby placing the upwardly directed path of the web close to the printing station;

a system guide roller (7) positioned close to said printing cylinders and guiding the path to the web from said guide roller (6) to the printing cylinders in essential alignment therewith, said system guide roller (7) in position in an essentially straight line between the movable guide roller (6) when said movable guide roller is remotely placed, and defining the path of the web when the movable guide roller is placed close to the printing station;

and movable support means (10) positionable essentially horizontally when the movable guide roller (6) is located to position the path of the web close to the printing cylinders, said support means being located at the side of the web remote from the printing cylinders and comprising a pivotable platform having a pivot axis adjacent the upwardly directed path (A) of the web when the guide roller (6) positions said path remote from said printing cylinders.

2. Printing machine according to claim 1 wherein said pivot arm (8), and hence said movable guide roller (6) thereon is movable to an intermediate position between the approximately horizontal and vertical positions in which the paper web path is remote from the printing cylinders or close to the printing cylinders, respectively, to provide for release of tension of the paper web.

3. Printing machine according to claim 1 wherein two paper webs are guided in parallel in said path (A, A'):

and said guide roller (6) comprises two guide roller elements (6, 9) located adjacent each other.

4. Printing machine according to claim 1, wherein the printing cylinders (2, 3) are located above each other, the paper web (5, 11) being introduced between the printing cylinders;

and further including a lower platform (10*a*) positioned at a level to provide access to the lower ones of the printing cylinders (3), the movable support means (10) being located above said lower support means (10*a*), when said movable guide roller (6) has moved the upwardly extending path (A') of the paper web close to the printing cylinders, to provide ready access to the upper ones (2) of the printing cylinders.

* * * * *